US005204510A

United States Patent [19]

McWilliams et al.

[11] Patent Number: 5,204,510

[45] Date of Patent: Apr. 20, 1993

[54] RADIANT ELECTRIC HEATERS

[75] Inventors: Kevin R. McWilliams, Stratford-Upon-Avon; George A. Higgins, Hagley, both of England

[73] Assignee: Ceramaspeed Limited, Droitwich, United Kingdom

[21] Appl. No.: 725,150

[22] Filed: Jul. 3, 1991

Related U.S. Application Data

[63] Continuation of Ser. No. 358,328, May 26, 1989, Pat. No. 5,051,561.

[30] Foreign Application Priority Data

| | | | |
|---|---|---|---|
| May 27, 1988 | [GB] | United Kingdom | 8812600 |
| Sep. 20, 1988 | [GB] | United Kingdom | 8822119 |
| Dec. 23, 1988 | [GB] | United Kingdom | 8830118 |
| Jan. 13, 1989 | [GB] | United Kingdom | 8800777 |

[51] Int. Cl.[5] ..... H05B 3/74

[52] U.S. Cl. ..... 219/464; 219/467; 219/466; 219/465

[58] Field of Search ..... 219/467, 465, 464, 466; 313/634, 317, 315, 578; 362/216

[56] References Cited

U.S. PATENT DOCUMENTS

| | | | |
|---|---|---|---|
| 1,267,287 | 5/1918 | Silverman | 362/216 |
| 1,444,400 | 2/1923 | Silverman | 362/216 |
| 2,278,951 | 4/1942 | Smith | 362/216 |
| 3,833,793 | 9/1974 | McWilliams | 219/464 |
| 4,243,874 | 1/1981 | Fischer | 219/467 |
| 4,296,311 | 10/1981 | Hagglund et al. | 219/464 |
| 4,700,051 | 10/1987 | Goessler | 219/464 |
| 4,727,241 | 2/1988 | McWilliams | 219/460 |
| 4,789,772 | 12/1988 | McWilliams | 219/464 |
| 4,845,340 | 7/1989 | Goessler | 219/464 |
| 4,910,387 | 3/1990 | McWilliams | 219/464 |

FOREIGN PATENT DOCUMENTS

| | | | |
|---|---|---|---|
| 0117346 | 2/1983 | European Pat. Off. . | |
| 0817601 | 6/1956 | United Kingdom . | |
| 1273023 | 5/1970 | United Kingdom | 219/464 |
| 2120006A | 5/1982 | United Kingdom . | |
| 2146431A | 4/1985 | United Kingdom . | |
| 2197169A | 5/1988 | United Kingdom . | |

*Primary Examiner*—Teresa J. Walberg
*Attorney, Agent, or Firm*—Browdy and Neimark

[57] ABSTRACT

A radiant electric heater (10) includes a layer of microporous thermal insulation (16) in a metal dish (12) and a peripheral wall (18) of ceramic fibre. A circular tungsten-halogen heating lamp (22) is supported in the dish above the insulation by its ends and by a protrusion (46) extending from the silica envelope (26) of the lamp. The protrusion extends sideways and is clamped between the insulation and the peripheral wall, and comprises a sealed exhaust tube used to evacuate and back-fill the lamp during its manufacture. Downwardly extending protrusions (120, 718) may be used instead of or in addition to sideways ones. A ridge (48) of the insulating material may also be provided, projecting up to engage with the underside of the lamp. This ridge may cooperate with the protrusion or with a clip (614) extending above the lamp to retain the lamp in position.

24 Claims, 17 Drawing Sheets

RADIANT ELECTRIC HEATERS

This is a continuation of application Ser. No. 07/358,328, filed May 26, 1989, now U.S. Pat. No. 5,051,561.

This invention relates to radiant electric heaters, and in particular to heaters of the kind incorporating an infra-red source such as an infra-red lamp.

BACKGROUND OF THE INVENTION

Infra-red radiant electric heaters incorporating infra-red lamps have been described, for example in patent specifications GB 1 273 023, EP 0 117 346 and GB 2 146 431. Such heaters are typically incorporated in cookers and cooktops having a flat, glass ceramic cooking surface. The type of lamp used comprises a tungsten filament supported inside a tubular envelope of fused silica, with electrical connections brought out through hermetic pinch seals at the ends of the envelope. In these heaters the infra-red lamps extend above a reflecting surface and are fixed in position by sandwiching both ends of the lamp envelope in the heater periphery or by bolting the electrical connections to a bracket. Although sandwiching the ends of the envelope is a satisfactory arrangement in the case of relatively short, straight lamps, it would not provide sufficient support in the case of other configurations such as the generally circular lamp shown in GB 1 273 023. In this latter case the lamp would be cantilevered, with the risk of excessive stress being applied to the lamp envelope. Bolting the electrical connections is even less desirable, since it subjects the hermetic pinch seal between the connections and the envelope to considerable stress, especially in the configuration of GB 1 273 023.

Nonetheless, a need exists for lamp configurations other than the existing short, straight arrangements. Such arrangements suffer from the disadvantage of emitting the radiation only from restricted portions of the overall heater area, and these portions do not have an optimum shape. This makes it difficult to provide a heated area with an appropriate distribution of radiation.

However, at present only short, straight lamps provide sufficient strength and rigidity of mounting to withstand typical use and more particularly the impact tests which such heaters are required to survive as a precaution against damage during transport, storage and use. It is easy to see for example that a heater with a circular lamp supported only at its (adjacent) ends, as in GB 1 273 023, would be very vulnerable to fracture of the lamp if it were dropped or subjected to shock from a utensil falling onto a glass ceramic cooking surface above the heater.

It is an object of this invention to provide a heater incorporating a lamp which may not be straight but is nonetheless adequately supported.

SUMMARY OF THE INVENTION

According to one aspect of this invention there is provided a radiant electric heater comprising a container; a layer of electrical and thermal insulating material disposed in the container; and at least one infra-red source means (such as an infra-red lamp) having an envelope transmissive of infra-red radiation, said source means being supported in said container at least in part by at least one protrusion extending from said envelope intermediate the ends of said envelope.

In such an arrangement the configuration of the infra-red lamp or other source means is not constrained as it is if the lamp is supported solely by its ends or by its electrical connections. In particular, the invention makes the use of circular lamps a practical and economic possibility, without risk of excessive stresses being applied to the lamp envelope.

Preferably the protrusion is of the same material as said envelope. The protrusion may comprise a sealed tube communicating with the interior of the envelope, for example a tube used to evacuate and back-fill the envelope during manufacture of the infra-red source means.

Radiant electric heaters for electric cookers commonly include a wall of insulating material extending around the periphery of a heated area in the heater above the layer of insulating material, and in this case the protrusion may engage with the wall. In particular, the protrusion may be sandwiched between the wall and the layer.

According to another aspect of this invention there is provided a radiant electric heater comprising a container; a layer of electrical and thermal insulating material disposed in the container; and at least one infra-red source means (such as an infra-red lamp) supported in said container at least in part by at least one protrusion from said insulating material intermediate the ends of said source means.

BRIEF DESCRIPTION OF THE DRAWINGS

Radiant electric heaters in accordance with this invention for use in a glass ceramic top domestic cooker will now be described, by way of example, with reference to the accompanying drawings, in which.

DESCRIPTION OF THE PREFERRED EMBODIMENTS

Figure 1:
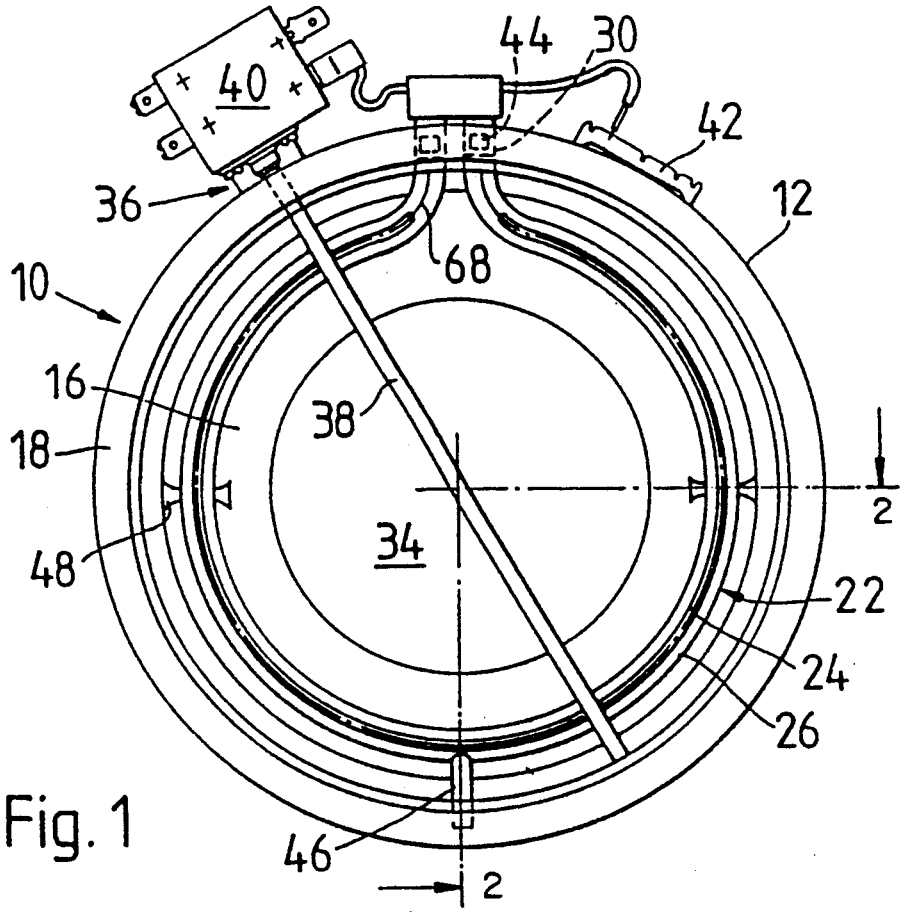
FIG. 1 is a plan view of a first heater.
Figure 2:
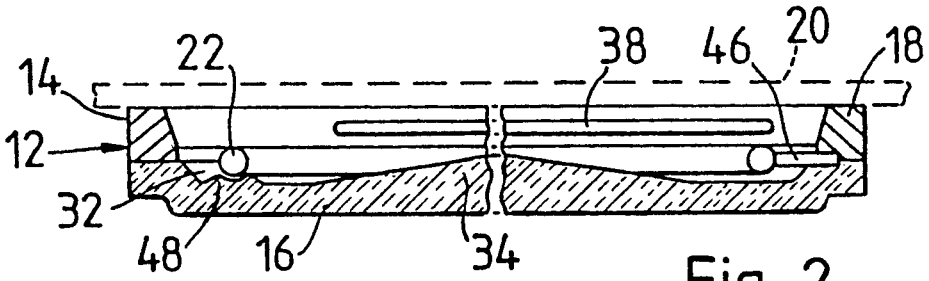
FIG. 2 is a sectional view of the heater of FIG. 1.
Figure 3:
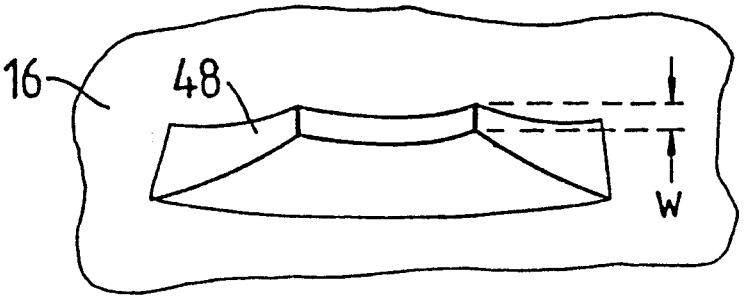
FIG. 3 is a perspective view of part of the heater of FIG. 1.

Referring to FIGS. 1 to 3, a radiant electric heater 10 has a container in the form of a metal dish 12 with an upstanding rim 14 and containing a layer of electrical and thermal insulating material 16. This material is for example a microporous insulation which comprises a silica aerogel powder mixed with ceramic fibre reinforcement, titanium dioxide opacifier and a small quantity of alumina powder to resist shrinkage, and which is pressed into the dish 12. A ring-shaped wall 18 of ceramic fibre extends around the inside of the rim 14 of the dish 12, on top of the layer 16 and protruding slightly above the edge of the rim 14. When installed in a glass ceramic top cooker the wall 18 is pressed against the underside of a glass ceramic cooking surface, shown in dashed outline at 20 in FIG. 2, the heater 10 being held in position by a spring or other mounting device (not shown). Prior to installation the wall 18 is retained in position by pins or staples (not shown) extending into the layer 16.

A heat source is provided in the form of a tungsten-halogen infra-red lamp 22. This lamp is generally circular in configuration and contains a tungsten filament 24 supported approximately axially within an infra-red transmissive fused silica envelope 26 on spacers (not shown). These spacers are arranged closely enough together to maintain the filament 24 at the desired distance from the envelope 26 in between each pair of spacers despite the curvature of the envelope 26. The filament 24 is secured at each end to connections brought out through flattened hermetic pinch seals 30 at the ends of the envelope 26. These ends are adjacent one another, and the pinch seals 30 extend generally radially of the heater 10 through recesses provided in the underside of the ceramic fibre wall 18 and in the layer 16, and through holes in the rim 14 of the dish 12.

The surface of the layer 16 is contoured, as shown in FIG. 2, to reduce the concentration of heat on the glass ceramic cooking surface 20 immediately above the lamp 22, and to maintain an adequate thickness for the layer 16. Thus under the lamp 22 there is an annular depression 32. Although the presence of this depression also helps to minimise the overall height of the heater 10, it is considerably broader than is required for this purpose alone, extending from the ceramic wall 18 to well within the inner circumference of the lamp 26. In addition to the depression 32, the central region 34 of the layer 16 is made slightly convex.

As is customary with heaters for glass ceramic top cookers, a temperature sensitive rod limiter 36 is provided with its probe 38 extending across the heater 10 above the lamp 22. This probe typically comprises a silica tube containing a metal rod, which is preferably plated with a reflective material, such as silver, as described in GB 2 146 431. A snap-action switch 40 controlled by the probe 38 is connected in series with the lamp 26, which in turn is connected to an electrical connector block 42 mounted at the edge of the dish 12.

To restrain the lamp 22 against movement relative to the layer 16, it is secured to the layer 16 at two spaced positions. Thus, where the pinch seals 30 extend under the wall 18, small raised pads 44 of the insulating material are formed in the layer 16 to engage the underside of the lamp 22, the upperside of which engages the wall 18. A second support point is provided diametrically opposite the pinch seals 30, in the form of an elongate exhaust tube 46.

The lamp 22 contains an atmosphere with a halogen gas to help prolong the working life of the lamp and to reduce blackening of the inside surface of the envelope 26. To this end the envelope 26 has at least one protrusion, in this case in the form of the tube 46, which is used to evacuate the envelope 26 and back-fill it with gas containing halogen during manufacture of the lamp 22. Thereafter the tube 46 is softened by heating and closed to seal the interior of the envelope 26.

As shown in FIGS. 1 and 2, the exhaust tube 46 is made long enough to extend across the space between the lamp 22 and the ceramic wall 18 and part way between the adjacent surfaces of the wall 18 and the layer 16. In this instance the exhaust tube 46 is positioned mid-way along the lamp 22. The tube 46 is restrained against movement by the wall 18 and the layer 16, and this restraint, together with the clamping of the pinch seals 30 between the wall 18 and the layer 16 supports the lamp 26 against side-to-side and up-and-down movement at diametrically opposed points.

In addition, at positions mid-way between the tube 46 and each pinch seal 30, small ridges 48 of the insulating material extend up from the layer 16 in the annular depression 32 towards the underside of the lamp 22. One of these ridges is shown in greater detail in FIG. 3, from which it can be seen to have the shape of a truncated elongate pyramid, with a concave top surface. Although the surface of the lamp 22 becomes very hot, the heat per unit length is less than in the case of straight lamps in a heater of equivalent power rating. This helps to avoid excessive heating of the insulating material forming the ridges 48. The dimension of each ridge 48 measured along the circumference of the lamp 22 (indicated by 'w' in FIG. 3) is minimised to limit its effect on the temperature distribution along the lamp. Thus it is possible to rely on heat conduction along the lamp 22 to limit the increased temperature of the lamp envelope 26 in the vicinity of each ridge 48.

The effect of the tube 46 is to limit potential movement of the lamp 22 to rotation about the axis extending from the tube 46 towards the pinch seals 30. However, such rotation would require upward movement of one side of the lamp and downward movement of the other side. Any such downward movement of either side of the lamp 22 is limited by the ridges 48.

The height of the ridges 48 is chosen so that there is a small clearance (for example 1-1.5 mm) between the top of each ridge and the underside of the lamp 22. This clearance reduces the risk of stress being imposed on the lamp 22 or the tube 46 owning to manufacturing tolerances in the dimensions and shape of the lamp 22.

Instead of using an exhaust tube to form a support as shown in FIG. 1, or in the absence of such a tube, a separate tube could be fused to the envelope 26 in such a manner as to maintain the sealing of the envelope 26 undisturbed.

Modifications are also possible to the ridges 48. Thus for example they may be in the form of ceramic pieces embedded in the layer 16, rather than formed in the layer 16 directly. Instead of isolated ridges, ribs extending across the layer 16 from its outer periphery may be provided. In the case of a relatively small heater the tube 46 alone may be sufficient, and the ridges 48 may be omitted.

Figure 4:
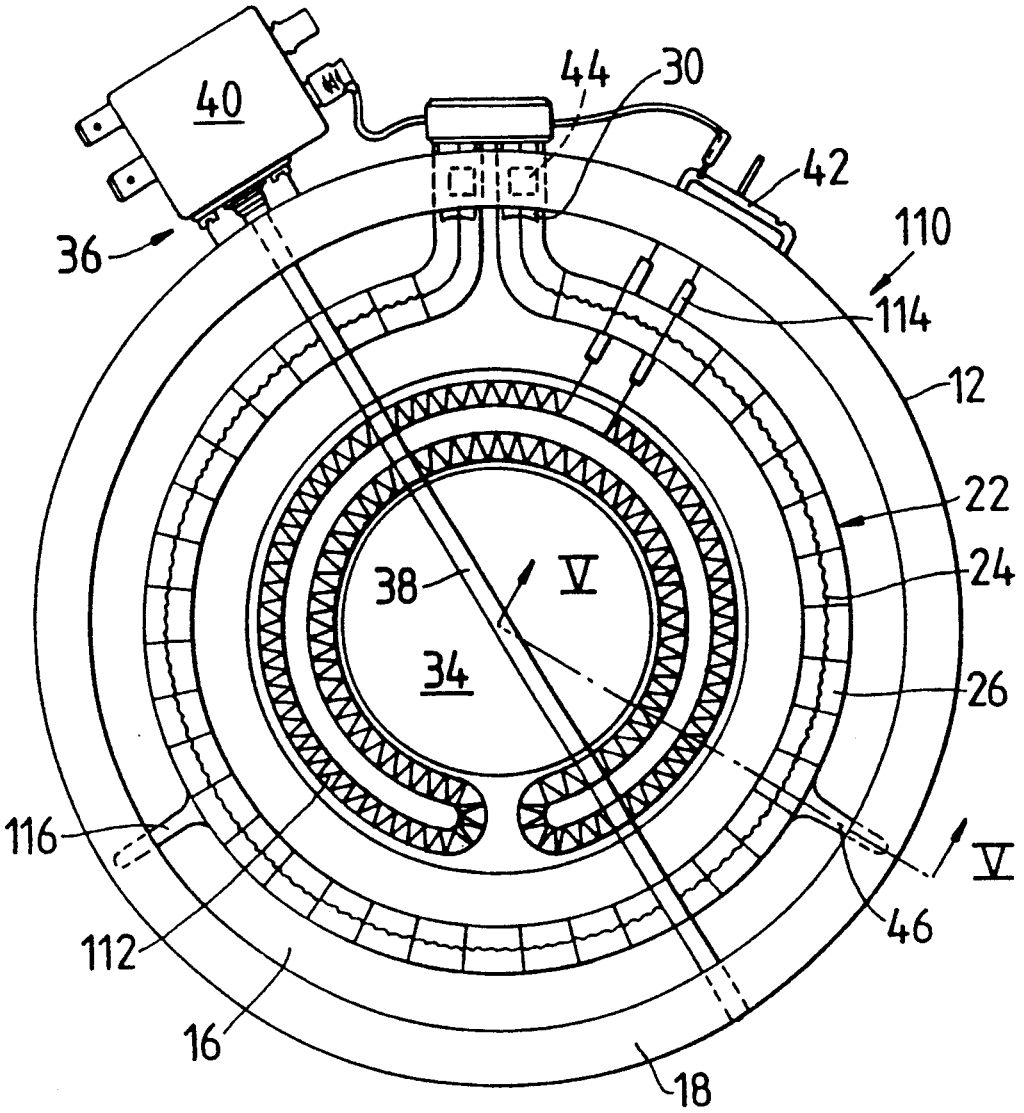
FIG. 4 is a plan view of a second heater.
Figure 5:
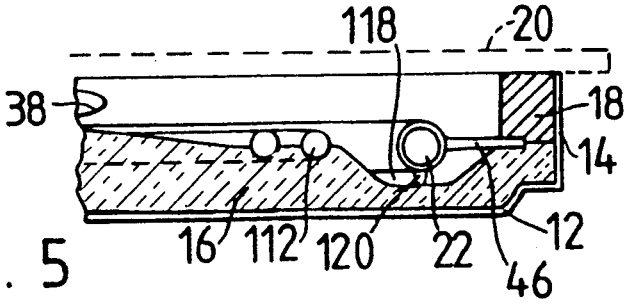
FIG. 5 is a sectional view of part of the heater of FIG. 4.

FIGS. 4 and 5 show another form of heater 110, in which parts corresponding to those of the heater 10 of FIG. 1 have like reference numbers. Referring to FIG. 4, the heater 110 includes a heating source additional to the lamp 22, in the form of a coiled bare resistance wire heating element 112. This element is disposed on the layer 16, within the area encompassed by the lamp 22, in a generally circular serpentine configuration to provide an aesthetically pleasing appearance whilst at the same time accommodating the required length of wire and promoting uniform heat distribution. The coiled element 112 is secured to the insulating material 16 by, for example, staples held by friction in the insulating material 16, or by gluing to the insulating material 16 or to stakes inserted therein. The ends of the wire heating element 112 are coupled to the electrical connector block 42. Where the wire of the coiled element 112 crosses under the lamp 22 it is provided with insulating sleeves 114 to limit the temperature of the wire at that point and also provide additional electrical isolation.

In the case of the heater 110 in FIG. 4, the exhaust tube 46 is positioned approximately one third the way around the circumference of the lamp 22 from one end. A second protrusion 116 in the form of another exhaust tube, or a length of silica tube or rod fused to the envelope 26, is located approximately one third the way around from the other end of the lamp 22. This second protrusion is of similar length to the exhaust tube 46, and is attached to the envelope 26 in such a way that it does not disturb the sealing of the interior of the lamp 22.

The protrusion 116 is restrained against movement by the wall 18 and the insulating material 16 in the same manner as the tube 46. Thus the lamp 22 is firmly supported at three points spaced evenly around its circumference, avoiding cantilevering and providing protection against undue stress on the envelope 26 for example in the vicinity of the pinch seals 30. Therefore the ridges 48 are in this case omitted.

The surface of the insulating material 16 is contoured as with the heater 10 and as shown in FIG. 5, to promote uniform distribution of heat around the heater 110. Thus under the lamp 2 there is an annular depression 118, and the insulating material 16 in the region within the coiled heating element 112 is made slightly convex.

The number, position and nature of the protrusions such as 46 and 116 can be varied. Thus more than two protrusions may be provided, for example three spaced from each other by a quarter the circumference of the lamp 22.

For additional strength the or each protrusion may be made long enough to extend completely across the ceramic fibre wall 18, into clearance holes provided in the rim 14 of the dish 12. In this way there is increased contact area and less risk of the ceramic fibre wall 18 being locally deformed.

Each protrusion may be an addition to the lamp 22, instead of using an exhaust tube as a protrusion. A protrusion need not extend out towards the ceramic wall 18; it may extend downwardly onto the insulating material 16, providing a support leg for the lamp 22 as shown in dashed line at 120 in FIG. 5. However, if every protrusion extends downwardly, some additional form of retention (such as a form of clip described hereinafter) may be desirable to restrain the lamp 22 against upward movement.

The heater 110 shown in FIGS. 4 and 5 has a circular lamp surrounding a circular coiled element. However, other arrangements are possible. Thus, in the heater 210 shown in FIG. 6, the lamp 22 may be disposed within the region inside a coiled heating element 212. In this case it may be preferable to arrange for short, straight sections of the element 212 to extend under the protrusions 46 and 116, to provide space for the protrusions and to limit the heat dissipation immediately under them.

Figure 6:
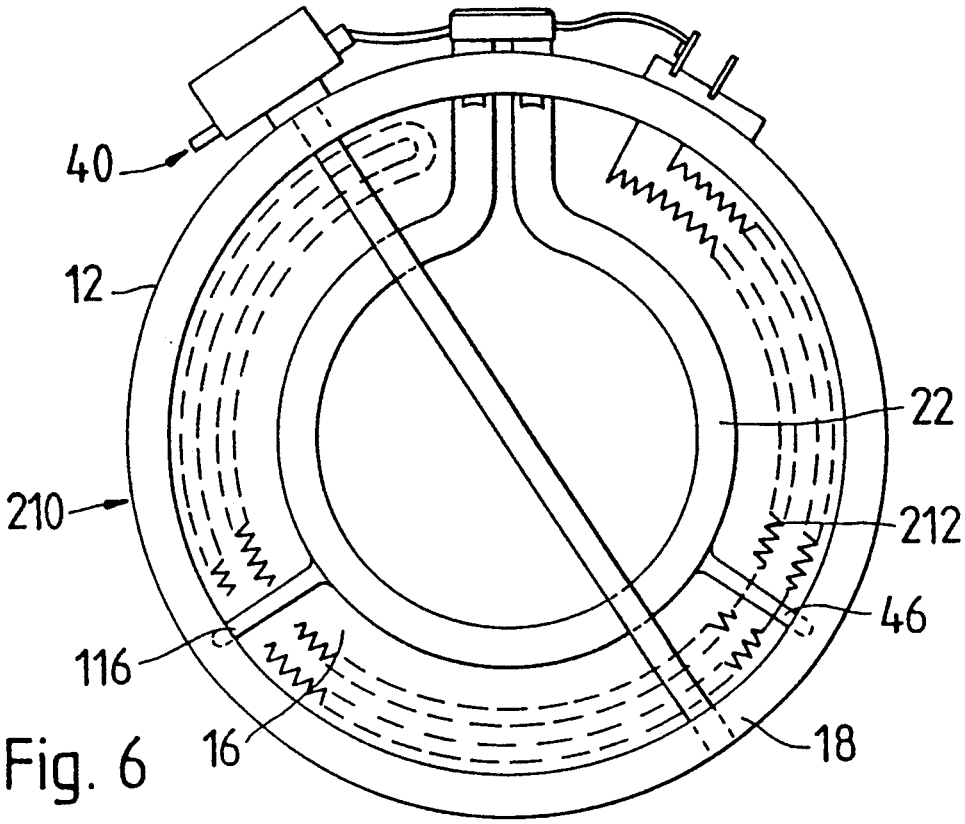
FIG. 6 is a plan view of a third heater.
Figure 42:
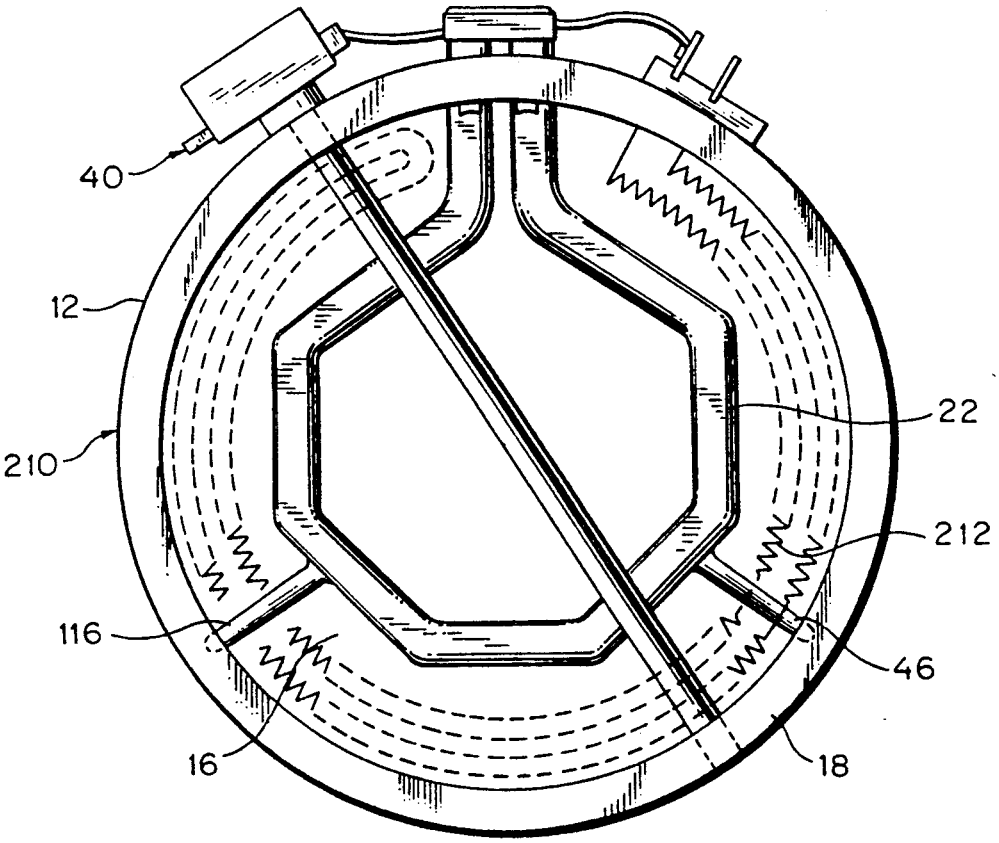

The heater 210 shown in FIG. 42 is substantially identical to that of FIG. 6 except that the lamp 22 is generally polygonal in shape.

Figure 7:
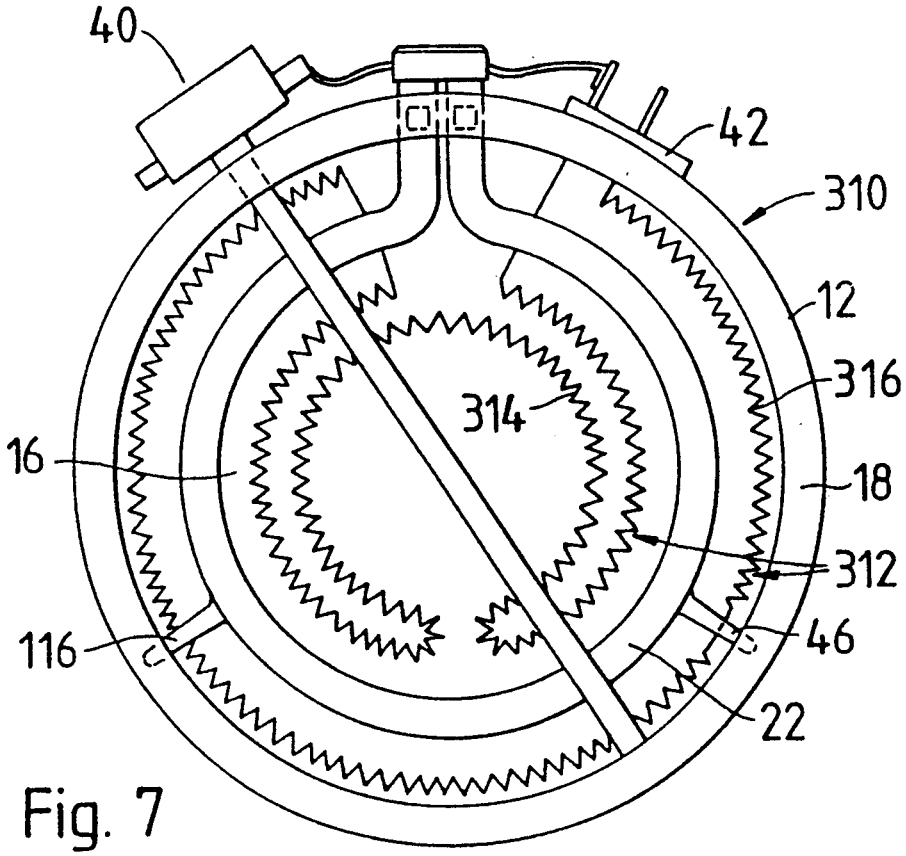
FIG. 7 is a plan view of a fourth heater.

FIG. 7 shows a heater 310 in which a coiled heating element 312 has two portions 314 and 316 extending respectively inside and outside the lamp 22. These two portions may be directly coupled in series, as shown in the Figure, or they may be individually connected to terminals in the connector block 42 to enable energisation of the elements in various configurations to provide several different power levels.

Figure 8:
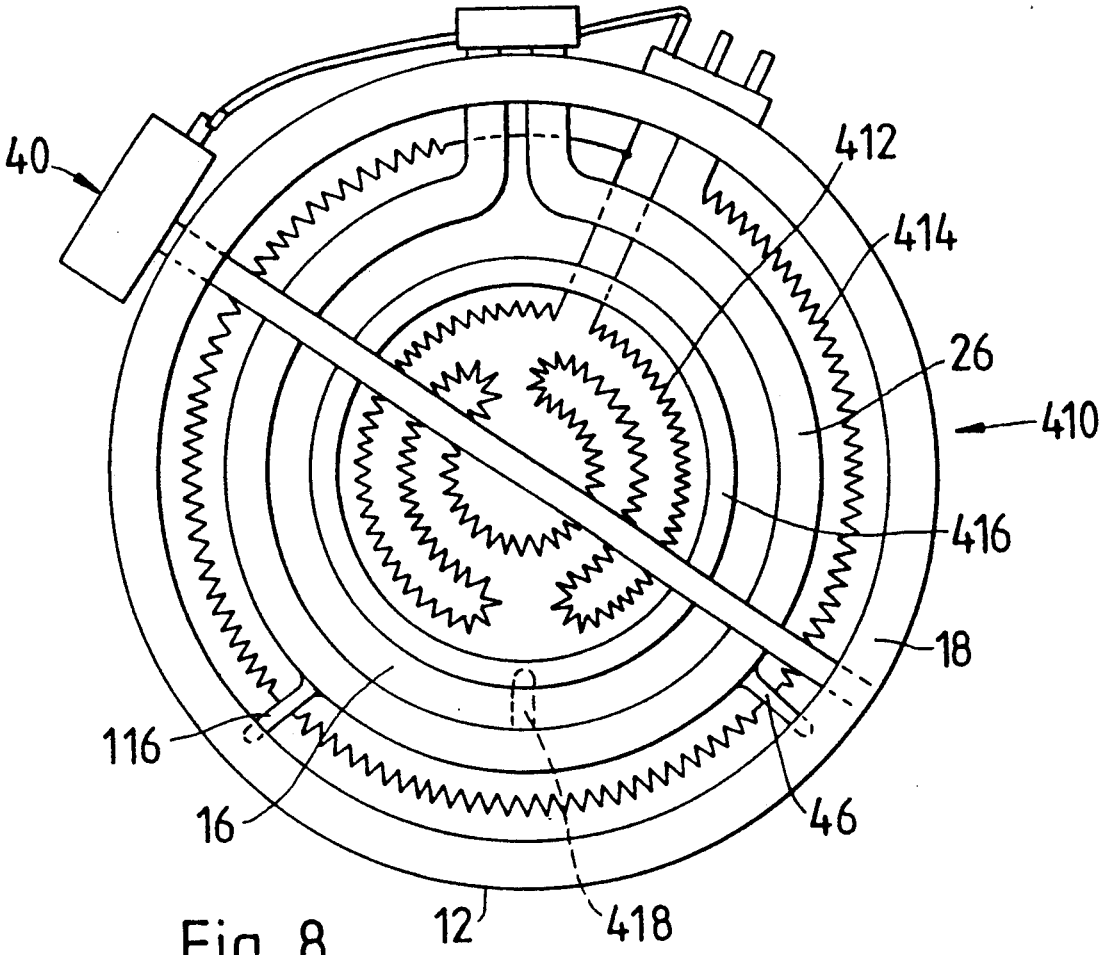
FIG. 8 is a plan view of a fifth heater.
Figure 9:
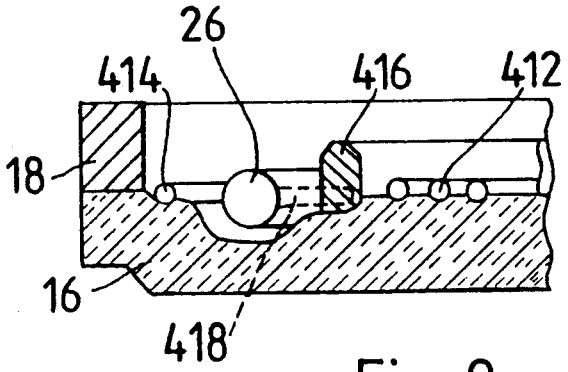
FIG. 9 is a sectional view of part of the heater of FIG. 8.

Alternatively separate coiled elements 412 and 414 may be provided on each side of the lamp 22, as in the heater 410 shown in FIGS. 8 and 9, to permit selective heating of differently sized areas of the heater 410. In this case, an inner wall 416 of ceramic fibre is preferably provided to divide the inner and outer heated areas. In these circumstances one or more inwardly directed protrusions may be provided, as indicated in dashed line at 418, instead of or in addition to the outward protrusions 46 and 116 of FIG. 4. Such an inwardly directed protrusion may be secured between the inner ceramic wall 416 and the layer of insulating material 16.

Figure 10:
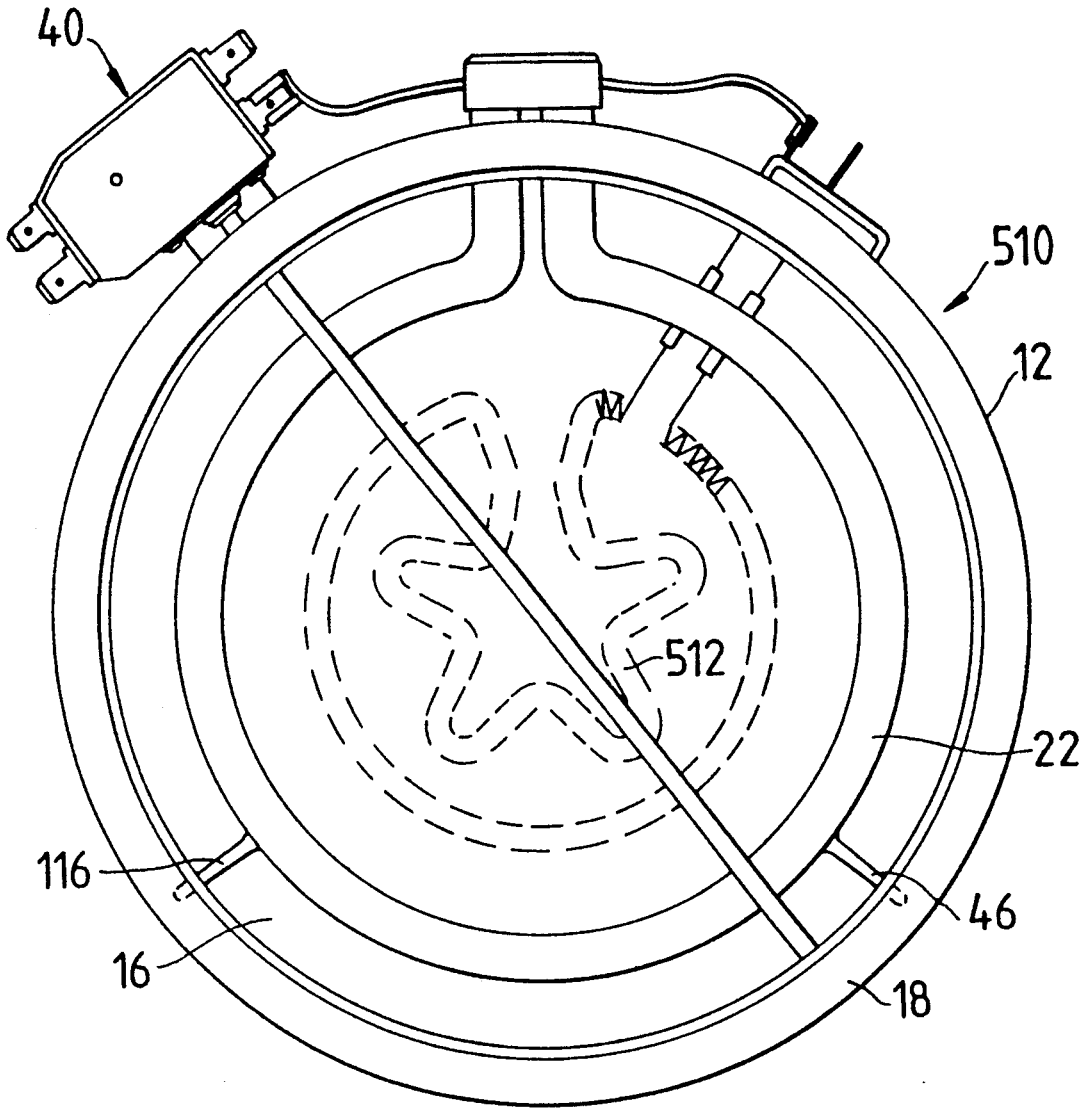
FIG. 10 is a plan view of a sixth heater.

FIG. 10 shows a heater 510 similar to that in FIG. 4, but with the innermost portion of a coiled element 512 configured in the shape of a star as indicated by the dashed outline.

Figure 11:
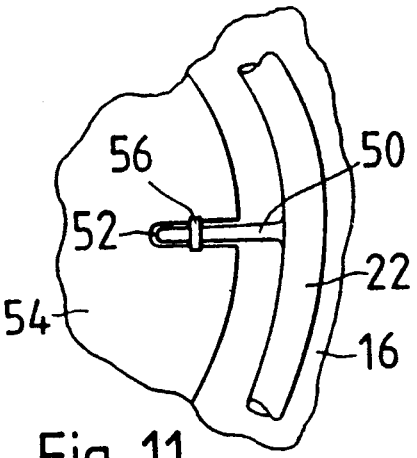
FIG. 11 to 18 illustrate various modifications that may be incorporated in heaters in accordance with the invention.
Figure 12:
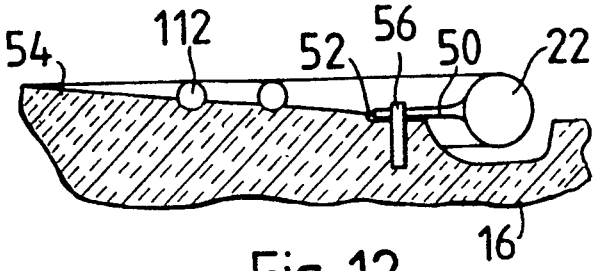

The protrusions supporting the infra-red lamp need not be secured between the ceramic fibre wall 18 and the insulating material 16. Thus, as shown in FIGS. 11 and 12, a protrusion 50 could be located in a recess 52 in a plateau 54 formed in the insulating material 16. The protrusion 50 may be secured for example by glue or by means of a staple 56 straddling the protrusion 50.

Figure 13:
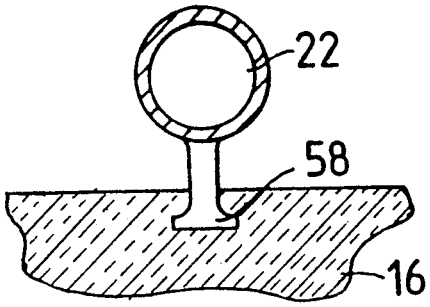
Figure 14:
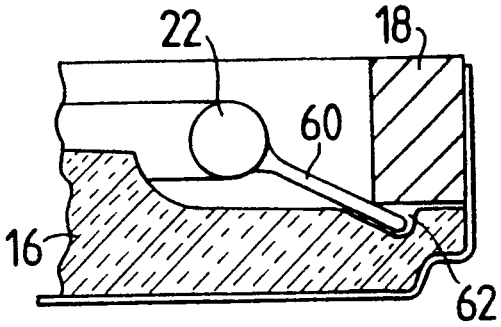
Figure 15:
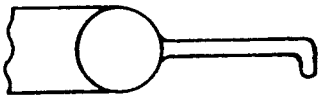
Figure 16:
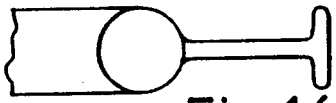
Figure 17:
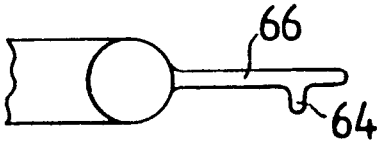
Figure 18:
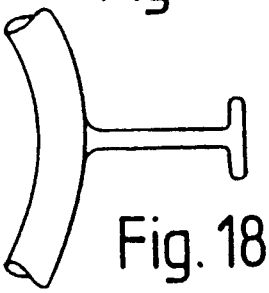

A downwardly directed protrusion may have an enlarged end 58, as shown in FIG. 13, designed to be embedded in the insulating material 16 to provide resistance to upward movement of the lamp 22. Alternatively a protrusion may be angled obliquely down from the lamp 22, as shown at 60 in FIG. 14, into a recess 62 in the insulating layer 16 under the ceramic fibre wall 18. This likewise provides support against both horizontal and vertical displacement.

FIGS. 15 to 18 illustrate various different configurations of protrusion, with transverse projections to provide additional support and retention. The configuration in FIG. 17, with a transverse projection 64 inward of the end of a protrusion 66, permits the protrusion 66 to rest on the insulating layer 16 as well as being clamped between that layer and the ceramic wall 18.

Figure 19:
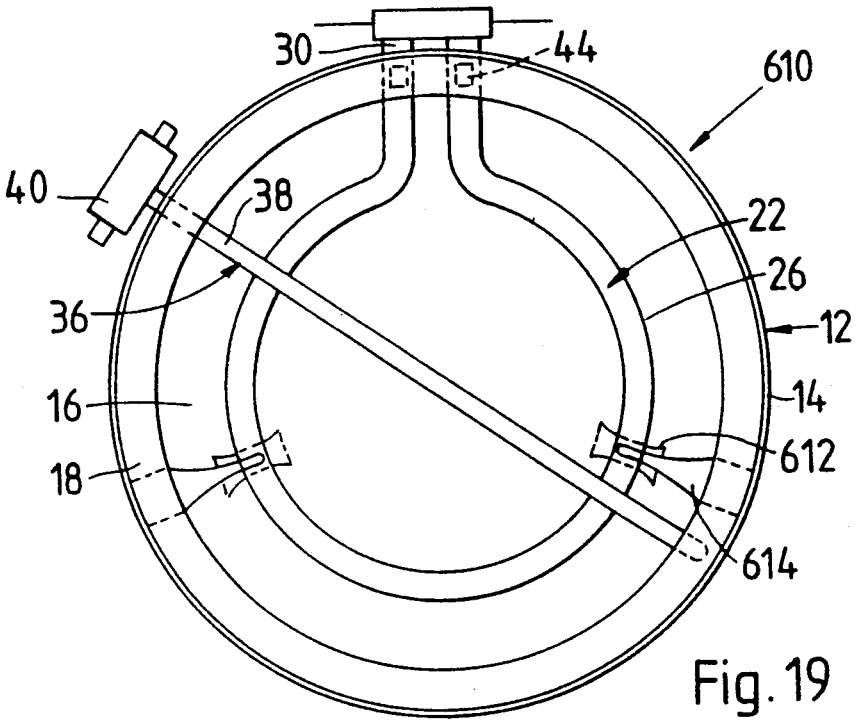
FIG. 19 is a plan view of a seventh heater.

FIG. 19 shows a heater 610 in which clips are used in conjunction with ridges of insulation material to retain the lamp 22 in position. Referring to FIG. 19, the configuration of the heater 610 is generally similar to that of the heater 10 of FIG. 1. However, to provide restraint of the lamp 22 against movement relative to the layer 16, a three-point or tripod type support arrangement is used. One element of this support arrangement comprises the pads 44 under the pinch seals 30. In addition, at positions spaced 120 degrees around the lamp 22, small ridges 612 of the insulating material, like the ridges 48, extend up from the layer 16 to engage the underside of the lamp 22. In this case there need not be any particular clearance between the ridges 612 and the lamp 22.

Above each ridge 612 there is a metal clip 614 extending inwards from the circumference of the heater 610 to engage the upper surface of the lamp 22, so that the lamp 22 is sandwiched between the ridges 612 and the clips 614 at two points around its circumference.

Figure 20:
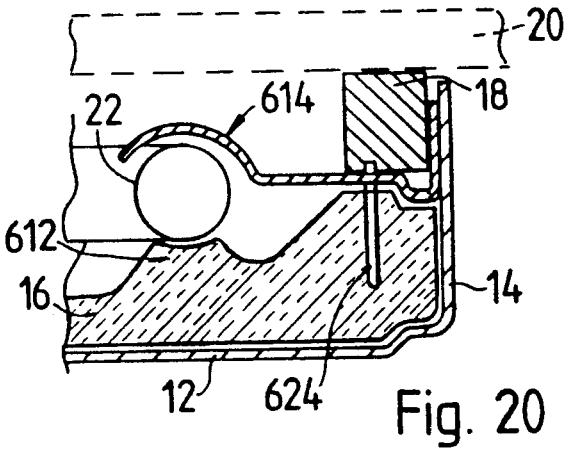
FIG. 20 to 26 show various forms of clip that may be incorporated in the heater of FIG. 19.
Figure 21:
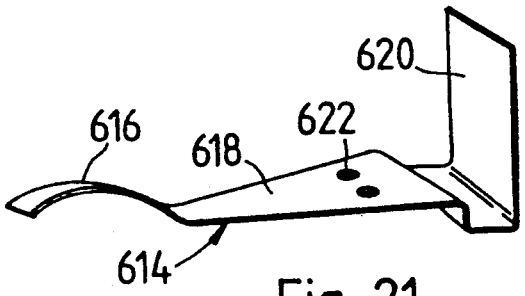

As shown in FIGS. 20 and 21, the clips 614 have an arcuate, elongate portion 616 extending inwards to engage the lamp 22, a base portion 618 which is sandwiched between the wall 18 and the layer 16, and an upstanding portion 620 located between the wall 18 and the rim 14 of the dish 12. The angle between the base portion 618 and the upstanding portion 620 is recessed, and holes 622 are provided in the base portion 618 to receive a staple 624, in order to inhibit dislocation of the clip 614.

Instead of the tops of the ridges 612 being concave, as shown in FIGS. 2 and 3, they may be flat, the clips 614 being used to provide radial location of the lamp 22.

Figure 22:
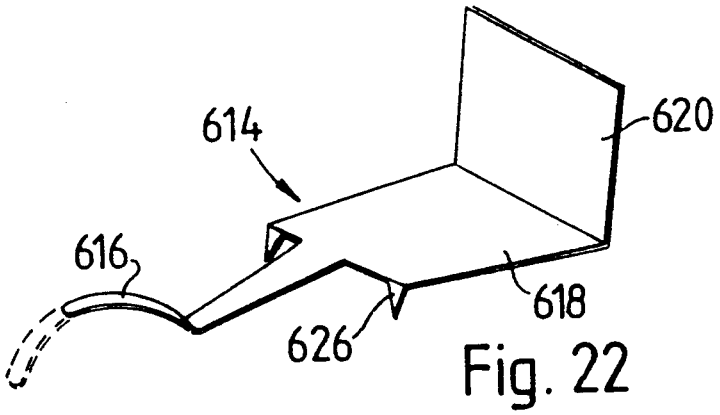

An alternative form for the clips 614 is shown in FIG. 22. In this case the base portion 618 of the clip has two downwardly-directed spikes 626 to engage in the layer 16 and restrain the clip 614 against displacement. As also shown in FIG. 22, the elongate portion 616 of the clips 614 may be a substantially complete semi-circle, as shown in dotted line, or it may be only a quadrant of a circle as indicated in solid line.

Figure 23:
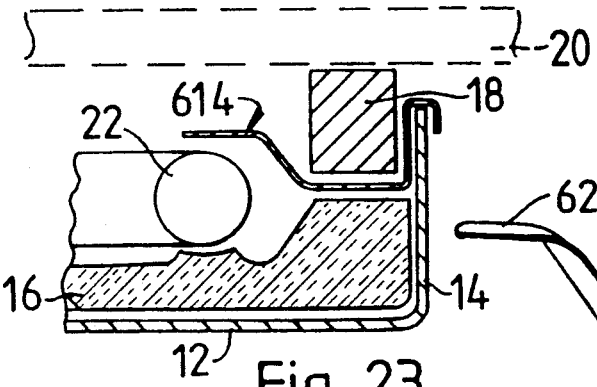
Figure 24:
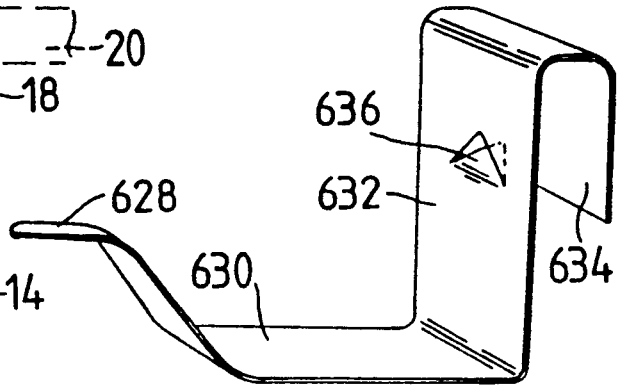

Another possible form for the clip 614 is shown in FIGS. 23 and 24. In this case the clip has a pointed portion 628 extending from one end of a base portion 630, from the other end of which there extends an upstanding portion 632 with a bent-over lip 634. The upstanding portion 632 has a triangular cut-out 636 bent towards the lip 634. The lip 634 is pressed down over the rim 14 of the dish 12, so that the cut-out 636 engages with the rim 14 and retains the clip 614 in position.

Figure 25:
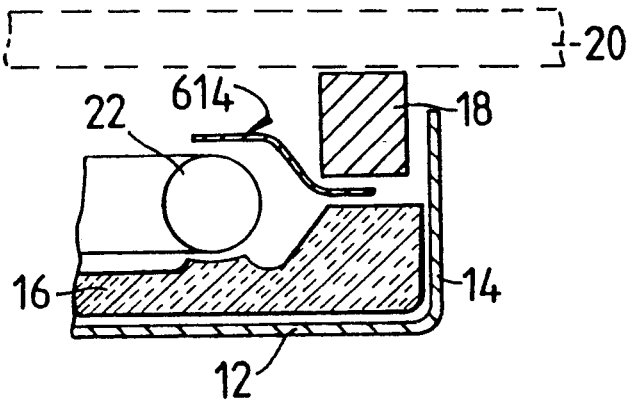
Figure 26:
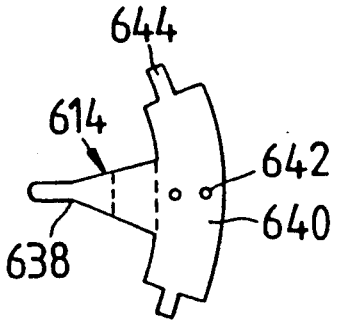

An additional form for the clip 614 is shown in FIGS. 25 and 26. Here the clip has a pointed portion 638 extending inwards to engage the lamp 22, and an arcuate base portion 640 which is sandwiched between the wall 18 and the layer 16. Holes 642 and lugs 644 are provided in the base portion 640 to permit the clip to be stapled to the layer 16. This configuration has the advantage of avoiding metal-to-metal contact between the clip 614 and the dish 12.

Instead of forming the clips 614 from sheet metal, they may be made of wire. Thus for example a clip may be made by bending a length of wire into a narrow V-shaped loop, with the ends extending sideways from the arms of the V. These ends are placed between the wall 18 and the layer 16, with the point of the V extending out over the lamp 22. Alternatively the wire may be bent into a T-shape, the cross-piece of the T being under the wall 18 and the leg extending over the lamp 22. The wire may be made of an iron-chromium-aluminium alloy and may be of the order of 1 mm in diameter. If desired a plate, for example of stainless steel, may be placed over the part of the clip under the wall 18 and stapled to the layer 16 to hold the clip down.

In the case of clips 614, whether made of sheet or wire, which are in contact with the dish 12, there may be a risk of electrical shorting to the dish 12 in the event that the envelope 26 breaks just under a clip 614 and allows it to come into contact with the filament 24. To guard against this problem the end of each clip 614 adjacent the lamp 22 may be coated with an electrical insulating material, for example a ceramic such as alumina which may be applied by flame-spraying. Such a coating will also tend to protect against any possible diffusion of metal from the clips 614 into the envelope 26 at high temperature.

Figure 27:
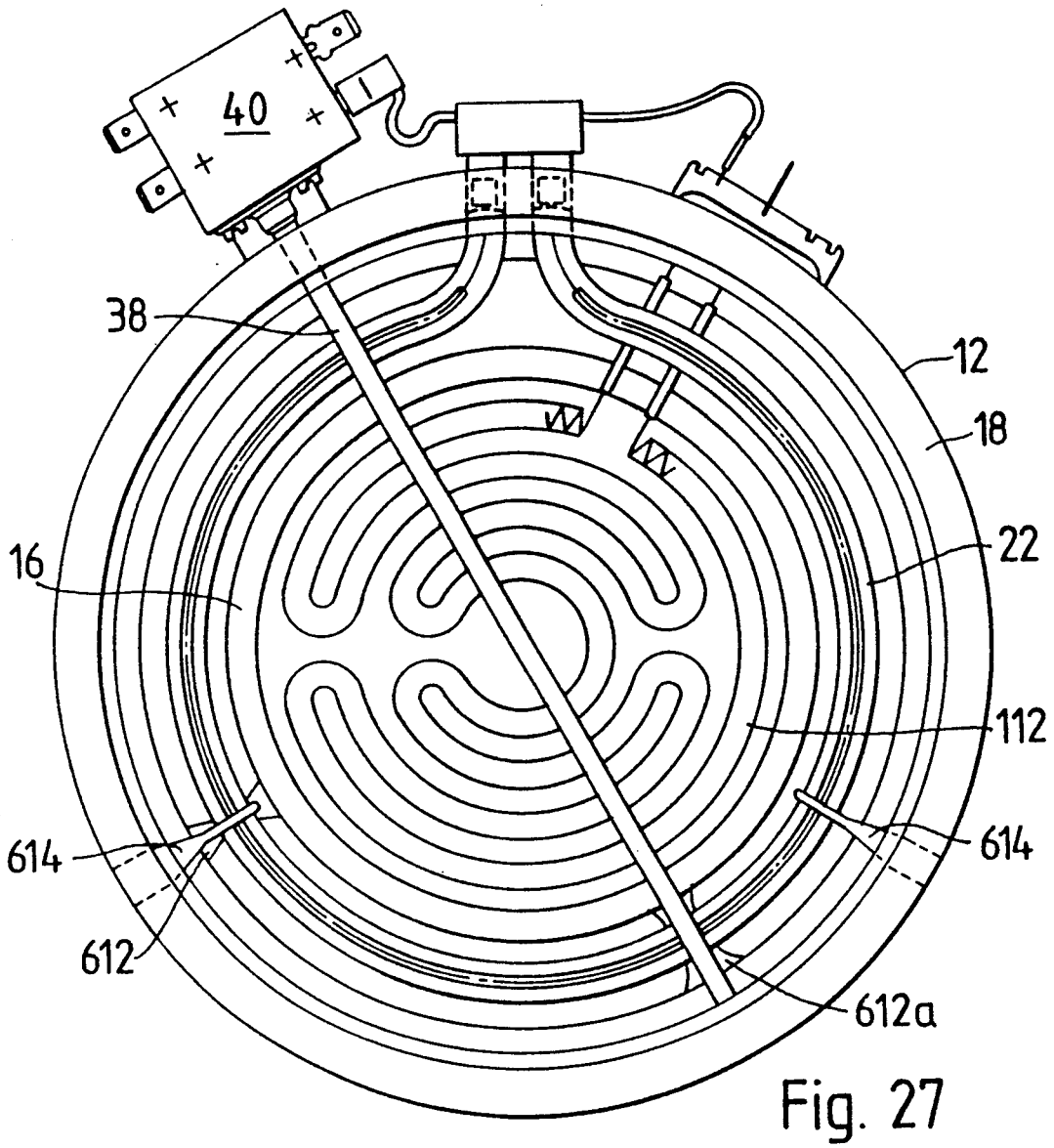
FIG. 27 is a plan view of an eight heater.

It is not essential for the ridges 612 to be located directly under the clips 614. Thus, as shown in the embodiment of FIG. 27, it is possible to have the clips 614 at 120 degree positions as explained above, but to locate one of the ridges 612 at an offset position 612*a* so that it supports the lamp 22 directly under the end of the limiter probe 38 remote from the ends of the lamp. This arrangement has the advantage that the adjacent clip 614 keeps the lamp 22 firmly in contact with the offset ridge 612*a*, thereby maintaining the desired clearance between the lamp 22 and the probe 38.

In another possible arrangement two ridges of insulation material are provided at 120 degree positions, as in FIG. 19, but there are three clips at angular spacings of 90 degrees form each other and form the pinch seals 30. Alternatively, only one clip may be provided, diametrically opposite the pinch seals 30. This would restrict the potential movement of the lamp 22 to rotation, in a similar manner to the tube 46 in FIG. 1, and such rotation would likewise be inhibited by the ridges without the need for clips directly above them. In this case the ridges could be either at 120 degree or 90 degree positions.

Figure 28:
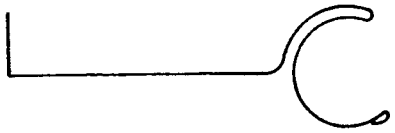
FIGS. 28 and 29 show additional forms of clip that may be incorporated in heaters in accordance with the invention.
Figure 29:
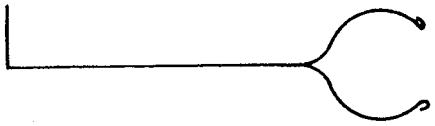

FIGS. 28 and 29 show alternate forms for the clips, in which they have two spaced arms arranged to clip over and embrace the envelope 26 of the lamp 22. With such clips it is possible to dispense with the ridges.

Figure 30:
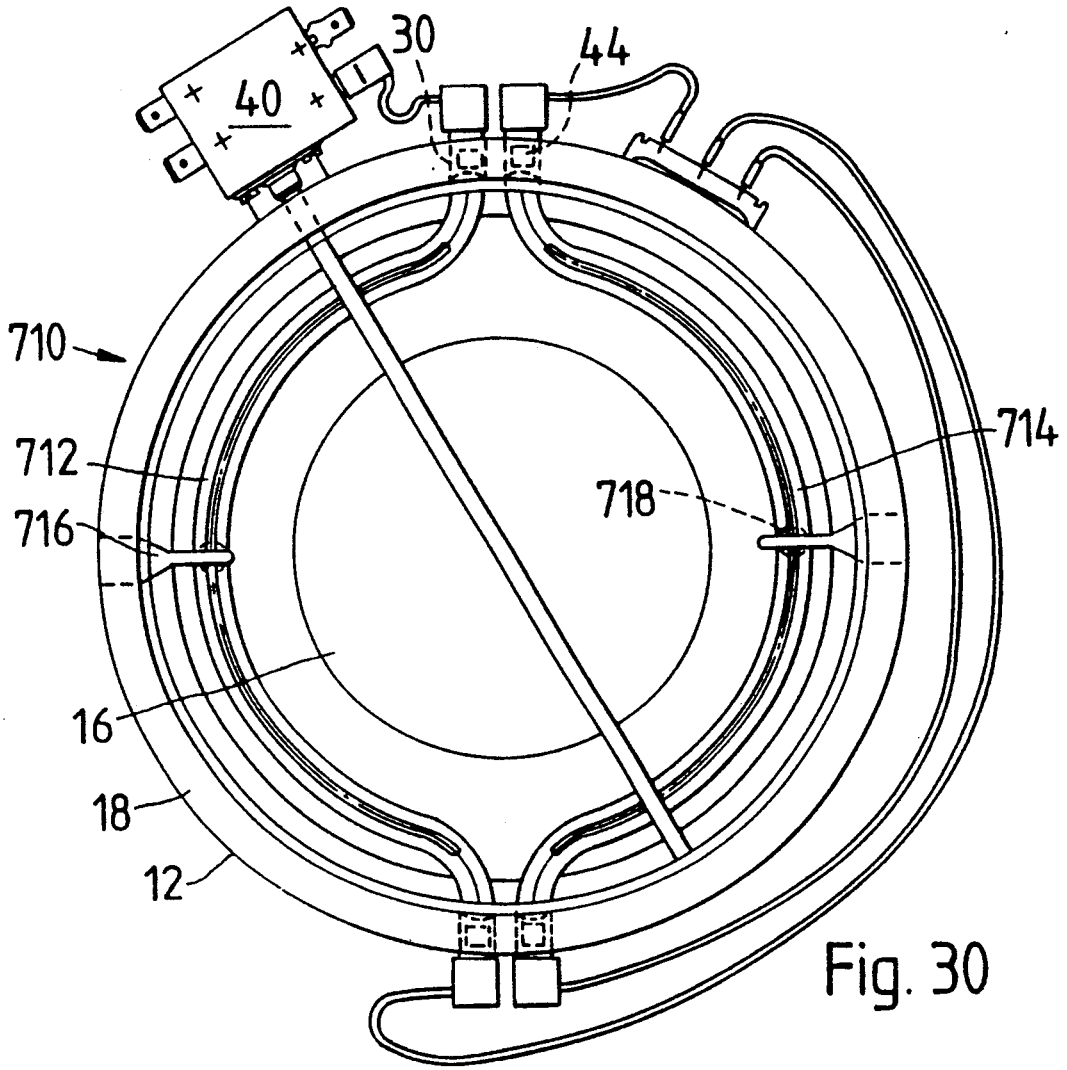
FIG. 30 is a plan view of a ninth heater.
Figure 31:
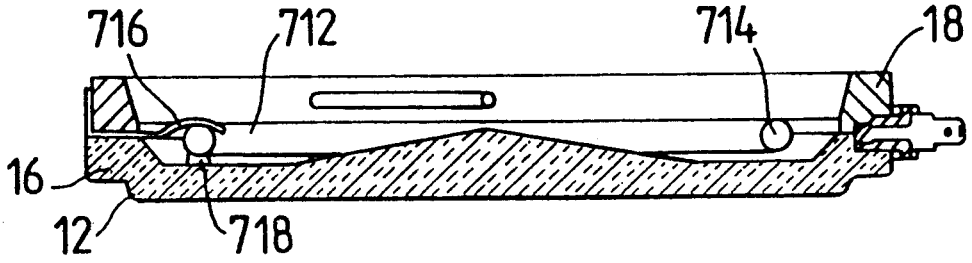
FIG. 31 is a sectional view of the heater of FIG. 30.

FIGS. 30 and 31 show another form of heater 710 in which two generally semicircular lamps 712 and 714 are used instead of a single circular lamp. This has the advantage that the filaments of the two lamps can be selectively switched in series or in parallel, providing different power levels, while retaining the same maximum power level as a single circular lamp. In this embodiment the lamps are well supported at each end, using pads 44 under the pinch seals 30 as in the heater of FIG. 1. However, restraint is needed to prevent each lamp 712 and 714 from rotating about the axis joining its ends. In the heater shown in FIG. 30, restraint against upward movement is provided by clips 716. However, restraint against downward movement is provided by a protrusion 718 on the lower surface of the envelope 26. This protrusion extends downwards to engage the surface of the layer 16 and maintain the lamp 22 at a predetermined distance above this layer. The protrusion 718 is squat and flattened in form and is conveniently made of silica fused to the envelope 26.

Alternatively, ridges of insulation material like the ridges 48 of FIG. 1 could be used instead of the protrusions 718; or a clip could be used to engage the underside of each lamp 712 and 714 as well as the upperside; or a tube like the tube 46 in FIG. 1 could be provided at the mid-point of each lamp 712 and 714 to engage between the wall 18 and the layer 16.

Figure 32:
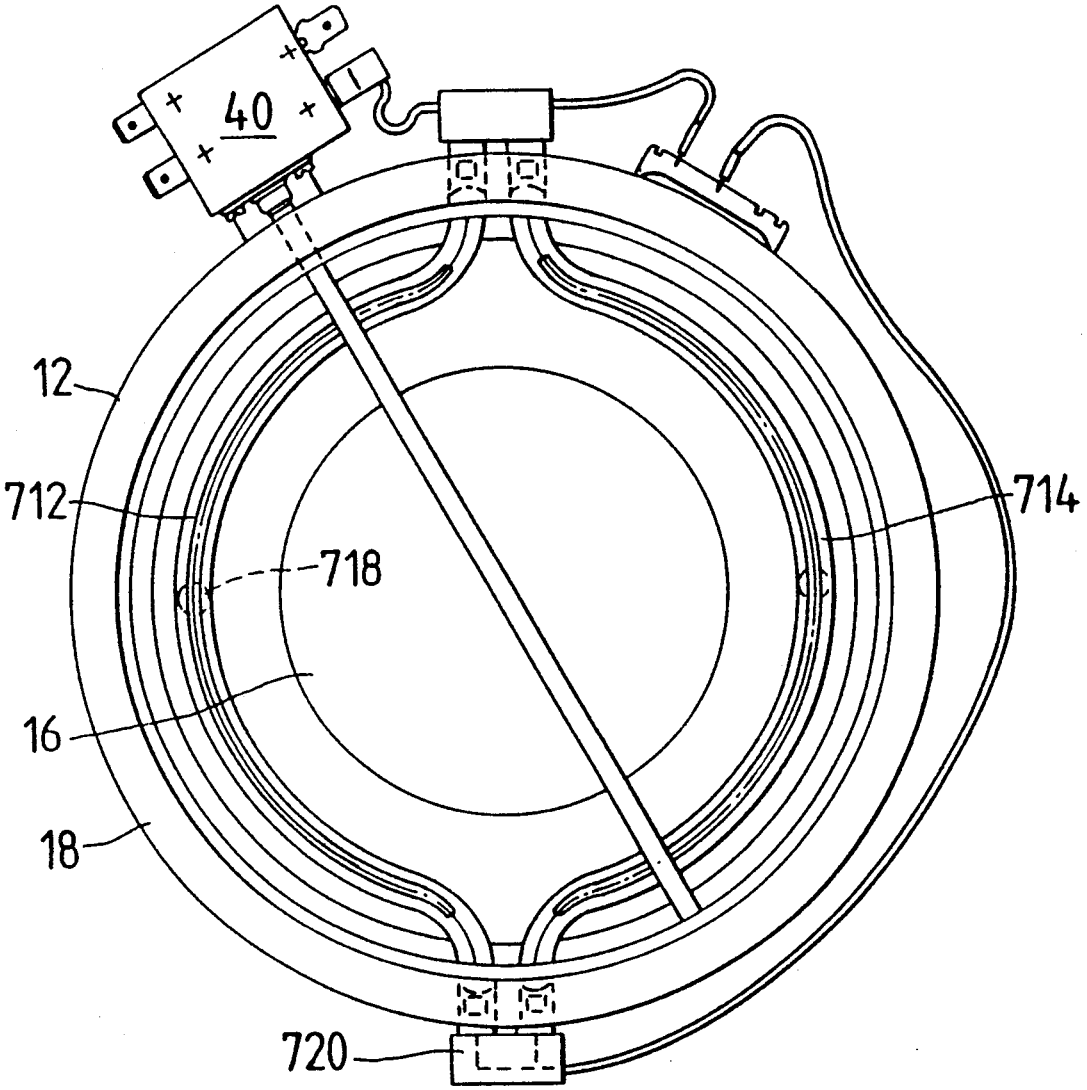
FIG. 32 is a plan view of a tenth heater.

In the modified form of heater with two semi-circular lamps shown in FIG. 32, the adjacent ends of the lamps 712 and 714 are connected together by a common ceramic endcap 720. As a result the lamps are joined to form a single integral body, with behaves mechanically in a similar manner to the circular lamp of FIG. 1. The primary mode of displacement is rotation about the axis extending between the lamp ends, and this is sufficiently restrained by protrusions 718 or ridges 48 under the lamps 712 and 714. Thus clips engaging the upper side of the lamps may be omitted.

As shown in FIG. 32, the filaments 24 of the two lamps 712 and 714 may be connected to separate conductors at one pair of lamp ends, but may be connected to a common conductor at the other pair of lamp ends. This simplifies the wiring of the heater while preserving the possibility of connecting the lamps 712 and 714 in series or in parallel. In order to provide additional power level options, a bare wire heating coil may be included in the heater of either FIG. 30 or 32, in a similar manner to the element 112 in FIG. 4 but with separate connections to permit various circuit configurations.

Figure 33:
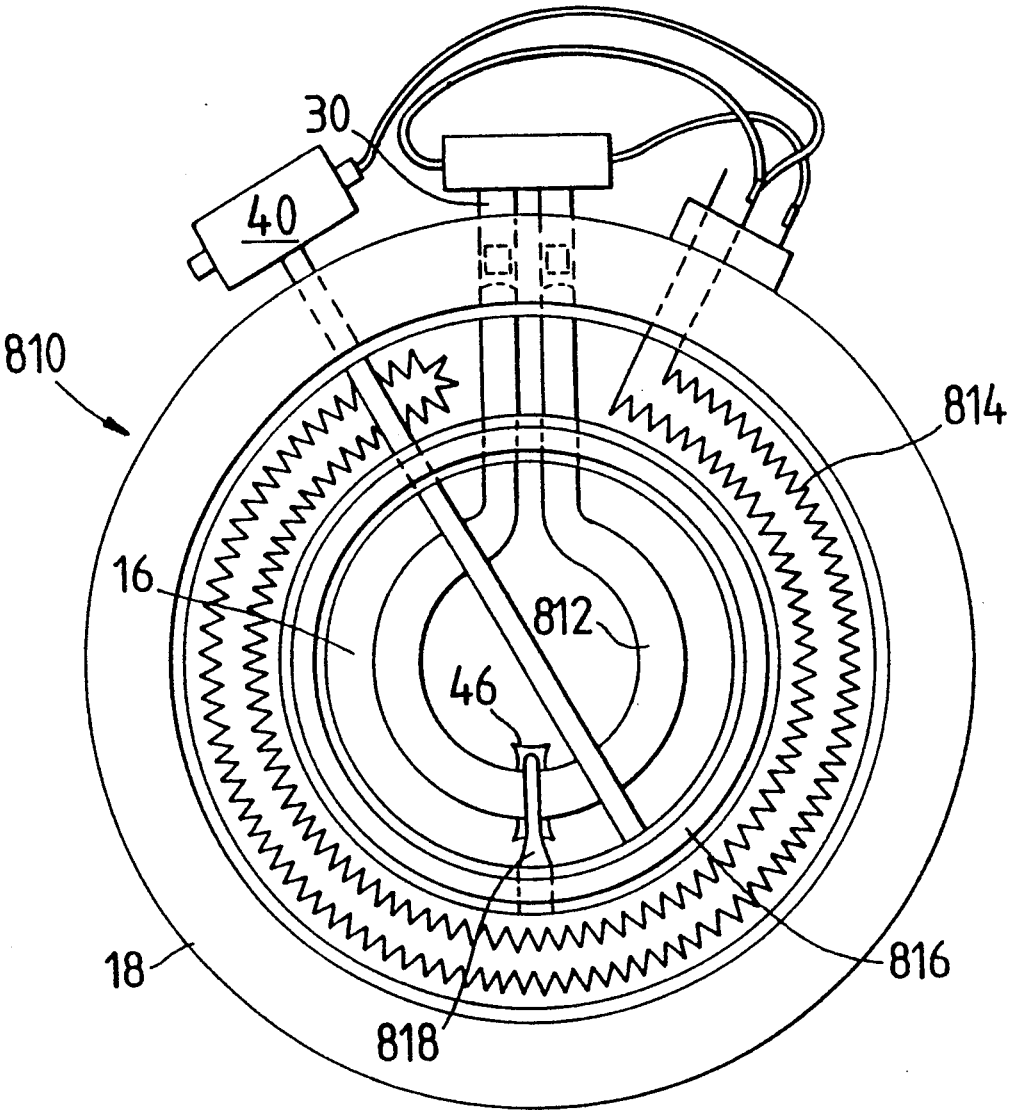
FIG. 33 is a plan view of an eleventh heater.

FIG. 33 shows a heater 810 having a small circular lamp 812 in the inner area of the heater and a bare wire heating element 814 surrounding the lamp 812, the element 814 and the lamp 812 being separated by a dividing wall 816 of the ceramic fibre. In this case the lamp 812 is restrained against movement at three points: at its pinch seals 30; at the point where its ends extend through the dividing wall 816; and by a ridge 48 and clip 818 secured between the dividing wall 816 and the layer 16, diametrically opposite the ends of the lamp 812.

Figure 34:
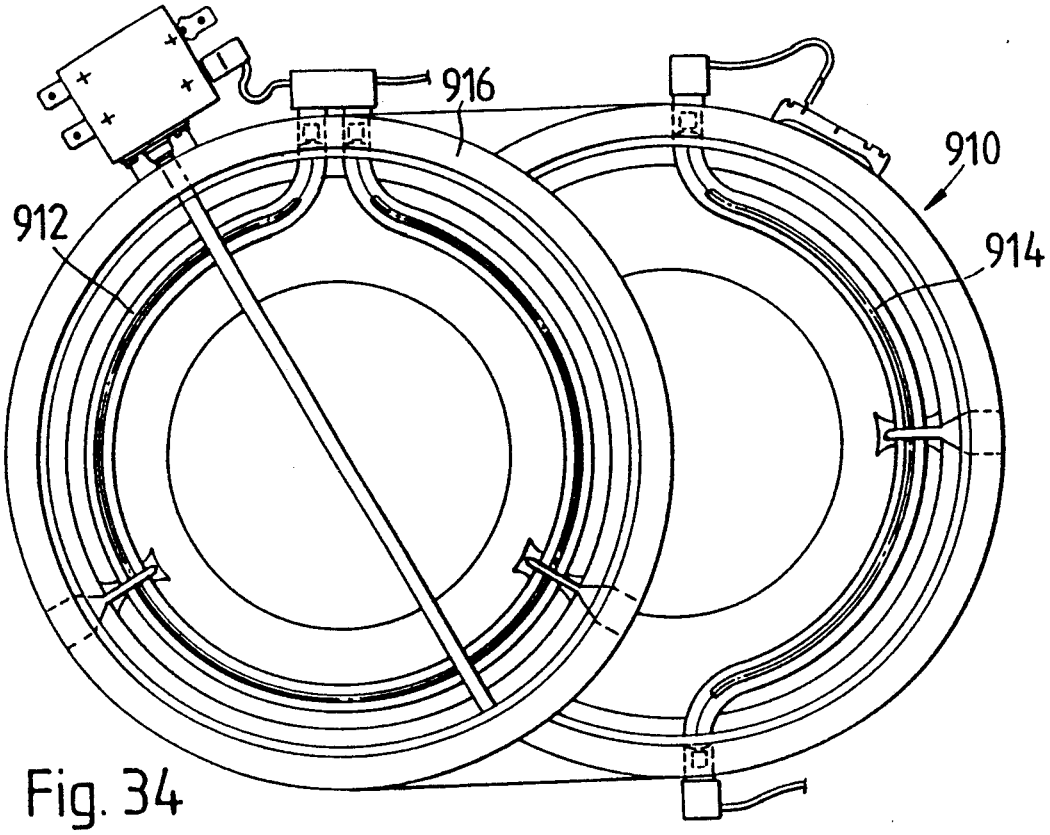
FIG. 34 is a plan view of a twelfth heater.
Figure 34A:
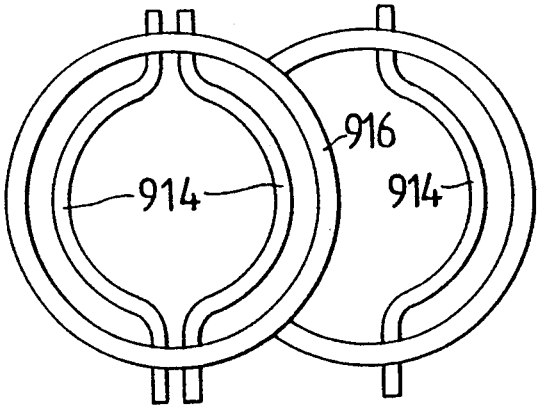
FIGS. 34*a* to 34*b* show modifications of the heater of FIG. 34.
Figure 34B:
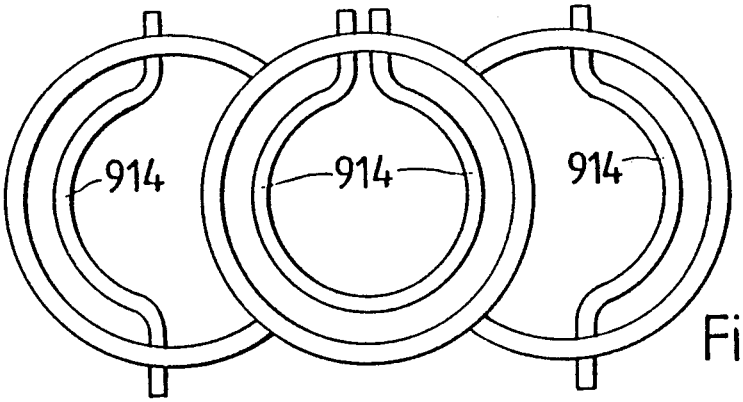

FIG. 34 shows a heater 910 having both a circular lamp 912 in a first heated area and a semi-circular lamp 914 in an adjacent, second heated area, with a dividing wall 916 of ceramic fibre separating the two areas. Energisation of the circular lamp 912 alone provides efficient heating of circular utenstils, while energisation of both lamps provides an oval heated area suitable for correspondingly shaped utensils such as casseroles. Instead of the circular lamp 912, two semi-circular lamps like the lamp 914 could be used as indicated schematically in FIG. 34*a*, to provide additional power level options. Furthermore, semi-circular lamps could be provided on both sides of a central circular area, as indicated in FIG. 34*b*.

Figure 35:
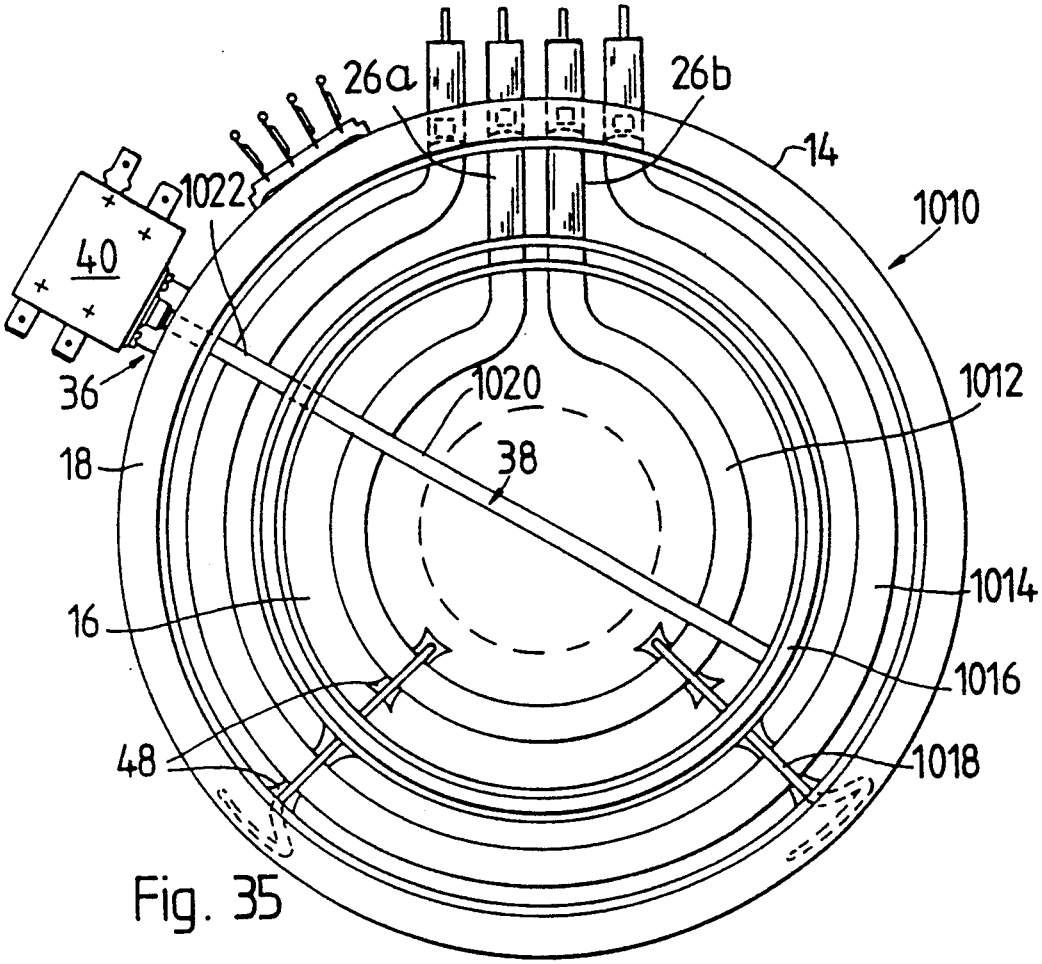
FIG. 35 is a plan view of a thirteenth heater.
Figure 36:
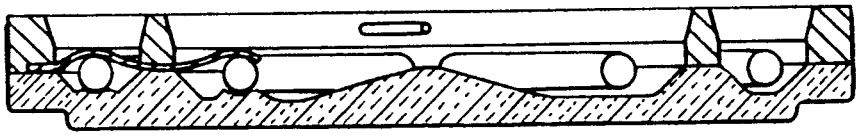
FIG. 36 is a sectional view of the heater of FIG. 35.
Figure 37:
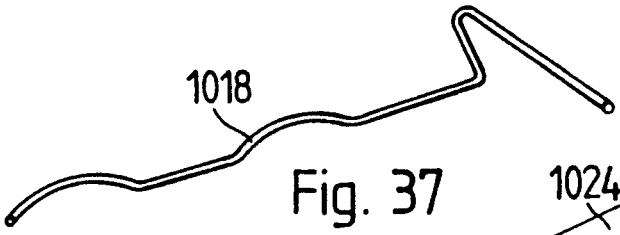
FIG. 37 is a perspective view of a component of the heater of FIG. 35.

FIGS. 35 and 36 show a heater 1010 having two concentric inner and outer lamps 1012 and 1014, separated by a dividing wall 1016 of ceramic fibre. The inner lamp 1012 is intended to be used alone for heating smaller diameter utensils, or together with the outer lamp 1014 for heating larger utensils. In order to reduce stray light when only the inner lamp 1012 is energised, the sections of its envelope 26*a* and 26*b* which traverse the annular part of the heater outside the dividing wall 1016 are coated with black paint, as are the ends of the lamp 1014 outside the rim 14. The lamps are restrained against movement by ridges 48 of insulation material and clips 1018 secured under the peripheral wall 18 and the dividing wall 1016. One of the clips 1018 is shown in FIG. 37, and they are secured by staples to the layer 16 of insulation material under both of the walls 18 and 1016.

The limiter 36 in the hater of FIG. 35 must be calibrated so that it operates to limit the temperature of the glass ceramic cooking surface correctly irrespective of whether only the inner lamp 1012 is energised or both lamps 1012 and 1014 are energised. Accordingly the limiter 36 is made insensitive to the heat in the annular area containing the lamp 1014. To this end, the outer tube of the probe 38 is made in two pieces, a silica section 1020 extending over the inner lamp 1012 and a metal section 1022 extending over the outer annular area of the heater 1010. This metal section 1022 has a similar coefficient of thermal expansion to the metal rod inside it, so that heat in the annular area of the heater 1010 has little or no effect on the operation of the limiter 36. However, there is a possibility of initial heating of the metal section 1022 causing delayed operation of the limiter when the lamps 1012 and 1014 are first energised. To avoid this, the metal section 1022 may be plated, for example with silver, in the same way as the metal rod inside the probe 38.

Figure 38:
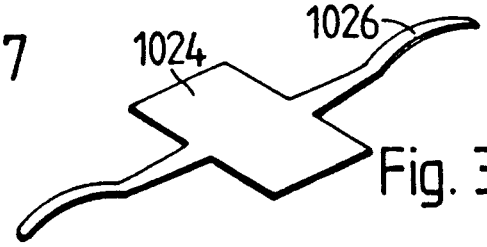
FIG. 38 is a perspective view of an alternative component for use in the heater of FIG. 35.

Instead of a clip 1018 extending inwards from the peripheral wall 18, a double-ended clip secured under the dividing wall 1016 may be used. Such a clip is shown in FIG. 38 and has a central base portion 1024 to be located under the dividing wall 1016, and arms 1026 extending in opposite directions to engage over the lamps 1012 and 1014.

Figure 39:
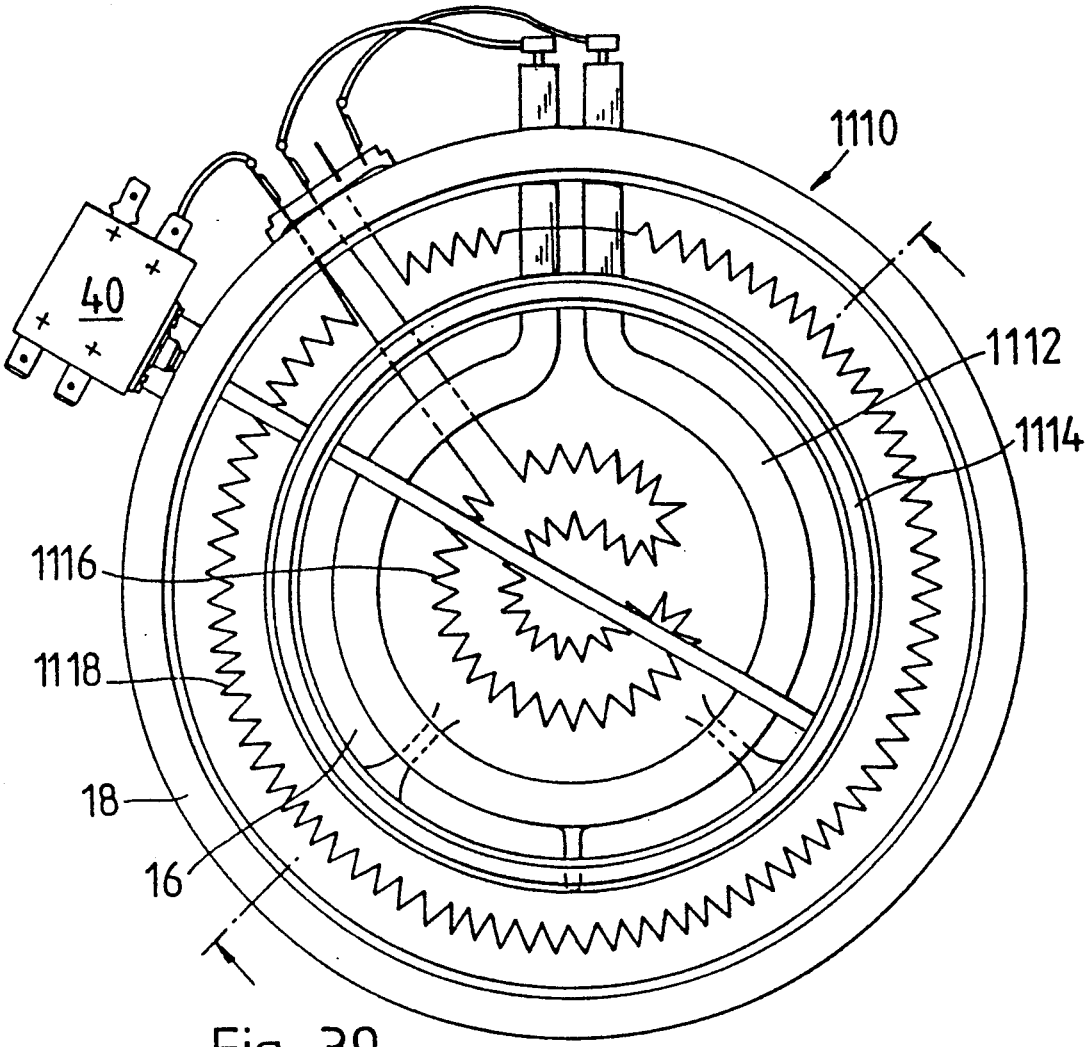
FIG. 39 is a plan view of a fourteenth heater.
Figure 40:
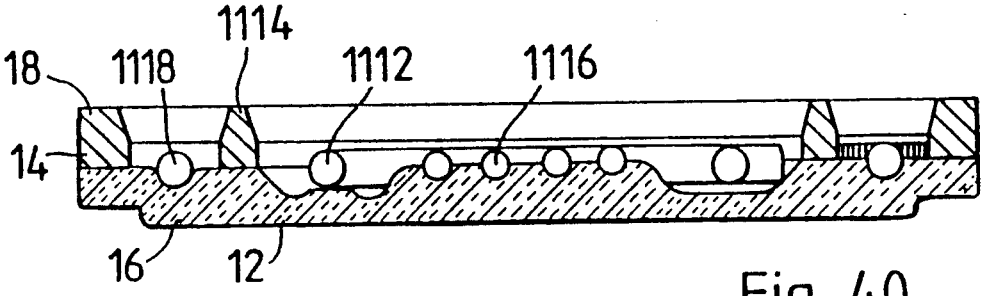
FIG. 40 is a sectional view of the heater of FIG. 39.

FIGS. 39 and 40 show a heater 1110 which can provide heated areas of two different sizes, as with the heater 1010 of FIG. 35, but which include two bare wire heating elements, one of which is used to limit lamp inrush current. A single lamp 1112 is provided, inside a dividing wall 1114, together with a first bare wire element 1116. The annular area outside the dividing wall 1114 contains a second bare wire element 1118 which is energised together with the lamp 1112 and the element 1116 for heating larger size utensils.

For aesthetic reasons, it is preferred that the illuminated part of the filament 24 in the lamp 22 of FIG. 1, for example, should not extend into the ends of the envelope 26. Accordingly the filament 24 is connected to a rigid support wire 68, curved to match the bend in the envelope 26. This support wire is welded to a section of molybdenum foil which is sealed within the pinch seal 30 and is connected to an external electrical connection.

It is also preferred that the non-illuminated arc between the ends of the filament should be as small as possible, and this constrains the bend between each end and the main body of the lamp 22 to have a small radius.

However, if an attempt is made to manufacture such a lamp with an acceptably small radius, a problem is encountered. The lamp is made by first forming and bending the fused silica envelope 26 to the required shape. One of the electrical connections and one of the rigid wires 68 are welded to a piece of molybdenum foil, and this assembly is connected to one end of the filament 24. The second support wire 68 is connected to the second end of the filament 24, and this end is threaded into one end of the envelope 26. The filament 24 is worked around the envelope 26 until it reaches the far end. In order to weld the molybdenum foil and the external connection to the support wire 68 at the second end of the filament 24, this support wire must be brought a short distance out of the end of the envelope 26. This in turn requires the end of the filament 24 already carrying its support wire and foil to pass temporarily into the envelope 26 and around the bend at that end.

It has been found that with a bend of the desired small radius of curvature it is very difficult or impossible for a support wire 68 of the desired length, with the foil and external connection, to travel sufficiently far into the envelope 26.

The lamp 22 can be made, but only by increasing the radius of the bend for at least one end of the lamp (although for aesthetic reasons the bend would typically be made the same on both sides of the lamp). As noted above, this increase the length of the non-illuminated arc in the energised lamp and is therefore considered undesirable.

Figure 41:
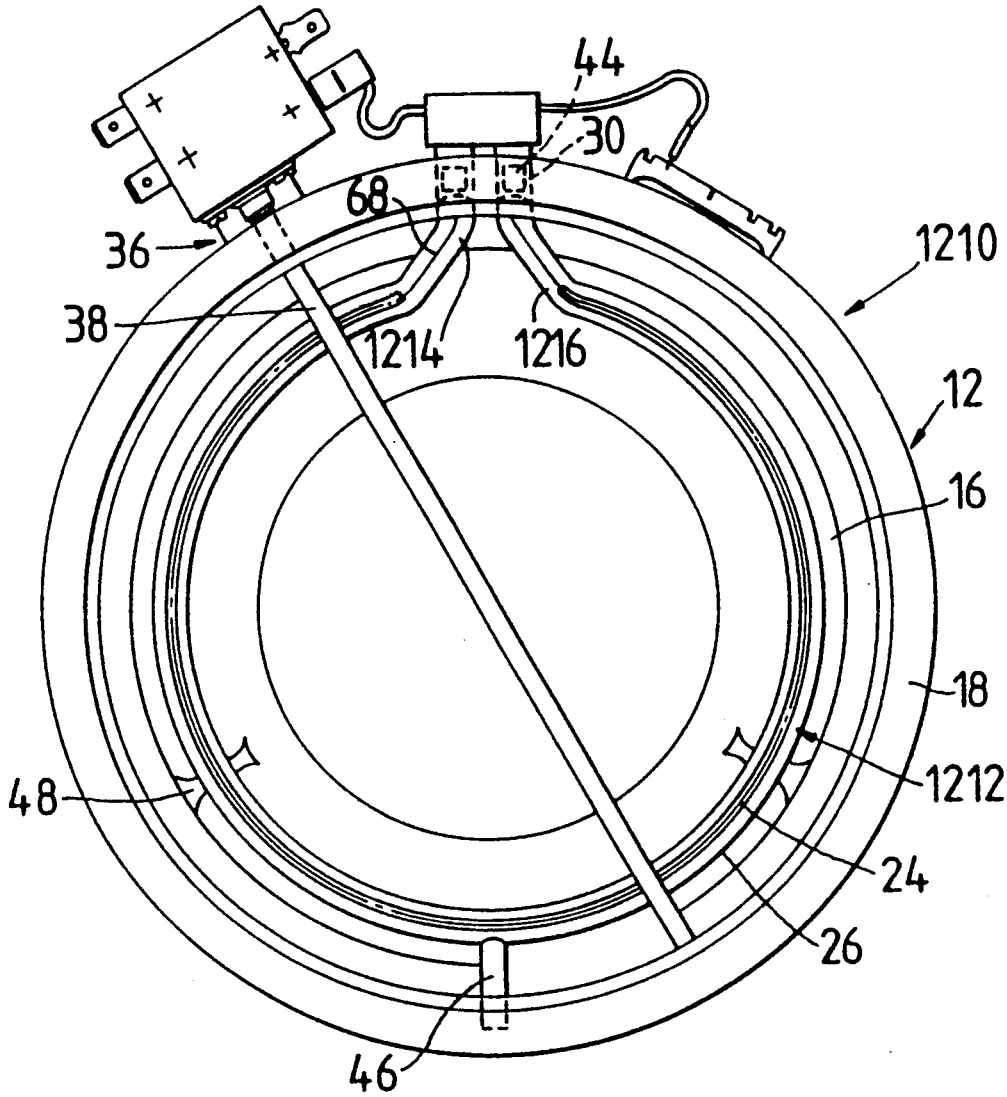
FIG. 41 is a plan view of a heater showing a modified lamp.

FIG. 41 shows a heater 1210 incorporating a lamp 1212 which avoids this problem. In making this lamp the envelope 26 is formed with two concave-outwards ends 1214 and 1216 in place of a single concave-outwards bend.

The bends 1214 and 1216 are both of smaller radius than the bend in the lamp 22 of FIG. 1, so the length of the non-illuminated arc is smaller than would be the case with a single bend of practicable radius. Nonetheless, we have found that the support wire 68 and the foil will travel further along the envelope 26 than would be the case with a single bend. In particular, they will travel far enough for the foil to be connected to the support wire 68 at the second end of the filament 24.

Each of the support wires 68 is preferably made with a small right-angled bend at the end to be welded to the molybdenum foil, in the same plane as the bends in the wire which match the bends 1214 and 1216 in the envelope 26. These bends are arranged to be coplanar prior to attachment of the filament 24. Thus, when the molybdenum foils are welded to the support wires 68, the foils and the bends in the support wires 68 with all be in the correct common plane.

The bend 1214 should be as close as possible to the end extremity of the envelope 26 while leaving sufficient room for the pinch seal 30. The second bend 1216 may be positioned as necessary, depending on the dimensions of the lamp 1212 and the envelope 26. The configuration of the envelope 26 between the bends 1214 and 1216 is not critical, but it can conveniently be generally straight as shown in the Figure.

The radii of the bends 1214 and 1216 may be made as small as practicable, within the constraints imposed by the manipulation of the fused silica material. The angle of each bend 1214 and 1216 may be approximately half the angle that would be required for a single bend; however, it is advantageous to make the bend 1216 larger than the bend 1214, since the angle of the bend 1214 has a significant effect on the length of the non-illuminated arc.

Various modifications may be made to the embodiments of the invention described above. Thus, instead of a geometrically circular lamp, it is possible to use a polygonal lamp made by heating and bending the envelope of a straight lamp at points spaced (preferably regularly) along it. With such a lamp the locations of support protrusions, ridges or clips may be determined to coincide with, for example, the mid-point of a straight segment of the lamp.

As noted above, the protrusions such as 46 and 116 (FIGS. 1 to 5) may be formed by one or more tubes used to exhaust the lamp envelope 26 during manufacture of the lamp. For a lamp 22 with an envelope 26 having an outer diameter of 8 to 10 mm such an exhaust tube typically has an outer diameter of 4 to 4.5 mm. This has been found to have adequate strength to support the lamp 22, but avoids the need for special shaping of the end of the exhaust tube to match the curvature of the envelope 26. It is envisaged that for these envelope diameters tubes or rods with a diameter somewhat smaller (e.g. 3 mm or less) or larger (e.g. 6 mm or more) may be used in specific embodiments, depending on such parameters as the size of the lamp and the distance between it and the point where the protrusion engages the layer 16 for example.

The particular combinations of lamp support arrangements and heat sources (lamps and wire coils) shown in the drawings are purely exemplary, and other combinations of these arrangements and sources may be used. Likewise other arrangements and combinations of protrusions, ridges and clips are possible.

We claim:

1. A radiant electric heater for cooking or heating appliances comprising:

a container;

a layer of electrical and thermal insulating material disposed in the container; and at least one infra-red source means having an envelope having ends and which is transmissive of infra-red radiation, said source means being supported against shock-induced displacement in said container at least in part by at least one elongate protrusion extending from said envelope intermediate the ends of said envelope, said elongate protrusion being supported by said thermal insulating material.

2. The heater of claim 1, wherein said at least one protrusion is of the same material as said envelope.

3. The heater of claim 2, wherein said at least one protrusion comprises a sealed tube communicating with the interior of the envelope.

4. The heater of claim 1, including a wall of insulating material extending over said layer, wherein said at least one protrusion engages with said wall.

5. The heater of claim 4, wherein said at least one protrusion is sandwiched between said wall and said layer.

6. The heater of claim 1, wherein said at least one protrusion engages with said layer.

7. The heater of claim 6, wherein said at least one protrusion is secured to said layer.

8. The heater of claim 7, wherein said at least one protrusion is secured by a staple.

9. The heater of claim 1, wherein said at least one protrusion extends generally parallel to aid layer.

10. The heater of claim 1, wherein said at least one protrusion extends generally perpendicularly to said layer.

11. The heater of claim 1, wherein said source means is supported in part by at least one protrusion form said insulating material.

12. The heater of claim 11, wherein said protrusion from said insulating material is intermediate the ends of said source means.

13. The heater of claim 11, wherein said protrusion from said insulating material is of the same material as said layer.

14. The heater of claim 11, wherein said protrusion from said insulating material is formed as an elongate ridge.

15. The heater of claim 11, wherein said protrusion from said insulating material has a curved upper surface.

16. The heater of claim 1, wherein said source means comprises a lamp having a filament sealed within an envelope, each end of the lamp being disposed at a predetermined angle relative to the portion of the lamp adjacent that end and the filament having relatively rigid end supports, and at least one end of the lamp has two successive bends which together provide said predetermined angle.

17. The heater of claim 1, wherein said layer has a generally annular depression under said source means.

18. The heater of claim 1, including a coiled wire heating element.

19. The heater of claim 18, wherein said source means is generally circular in configuration and said element is disposed on said layer within an area bounded by said source means.

20. The heater of claim 18, wherein said wire heating element has a straight portion adjacent said at last one protrusion.

21. The heater of claim 1, wherein said source means is generally circular in configuration.

22. The heater of claim 1, wherein said source means is generally polygonal in configuration.

23. A radiant electric heater for cooking or heating appliances comprising:

a container;

a layer of electrical and thermal insulating material disposed in the container; and at least one infra-red source means having an envelope having ends and which is transmissive of infra-red radiation, said source means being supported within said container by said insulating material against shock-induced displacement at least in part by at least one elongate protrusion extending from said envelope intermediate the ends of said envelope.

24. A radiant electric heater for cooking or heating appliances comprising:

a container;

a thermal insulating material disposed in the container and including a layer of electrical and thermal insulating material; and at least one infra-red source means having an envelope having ends and which is transmissive of infra-red radiation, said source means being supported within said container against shock-induced displacement at least in part by at least one elongate protrusion extending from said envelope intermediate the ends of said envelope and engaging with said thermal insulating material.

* * * * *